United States Patent [19]

Marsh

[11] 4,185,563

[45] Jan. 29, 1980

[54] COMBINATION SEAT AND STEP ARRANGEMENT FOR RAILWAY PASSENGER COMPARTMENT

[75] Inventor: Ronald W. Marsh, Michigan City, Ind.

[73] Assignee: Pullman Incorporated, Chicago, Ill.

[21] Appl. No.: 850,190

[22] Filed: Nov. 10, 1977

[51] Int. Cl.[2] ..... B61D 31/00; B61D 33/00

[52] U.S. Cl. ..... 105/345; 105/326; 182/35; 182/129; 297/113

[58] Field of Search ..... 105/314–322, 105/326, 336, 344–347, 431, 443, 447, 450; 182/33, 35; 297/115, 113; 244/129.6; 280/166, 163, 164 R, 164 A; 296/63, 66, 69

[56] References Cited

U.S. PATENT DOCUMENTS

| | | | |
|---|---|---|---|
| 255,327 | 3/1882 | Owen | 280/164 R |
| 451,516 | 5/1891 | Plaut | 105/326 |
| 468,493 | 2/1892 | Charles | 105/326 |
| 485,151 | 10/1892 | Charles | 105/326 |
| 544,892 | 8/1895 | Gunzburg | 105/315 |
| 1,233,113 | 7/1917 | Odell | 105/315 |
| 1,479,594 | 1/1924 | Fennell | 182/33 |
| 4,046,081 | 9/1977 | Gutridge | 105/326 |

*Primary Examiner*—Edward R. Kazenske
*Assistant Examiner*—Frank F. Atwood
*Attorney, Agent, or Firm*—Richard J. Myers

[57] ABSTRACT

A combination seat and step arrangement for a railway sleeping compartment having components of the seat forming a step or ladder and a seat assembly. The seat includes a lateral part which is hinged upwardly and an upper lateral part of the back rest hinged to swing over the raised lateral part and locked therewith to provide a step alongside the main seating section.

11 Claims, 4 Drawing Figures

FIG. 1
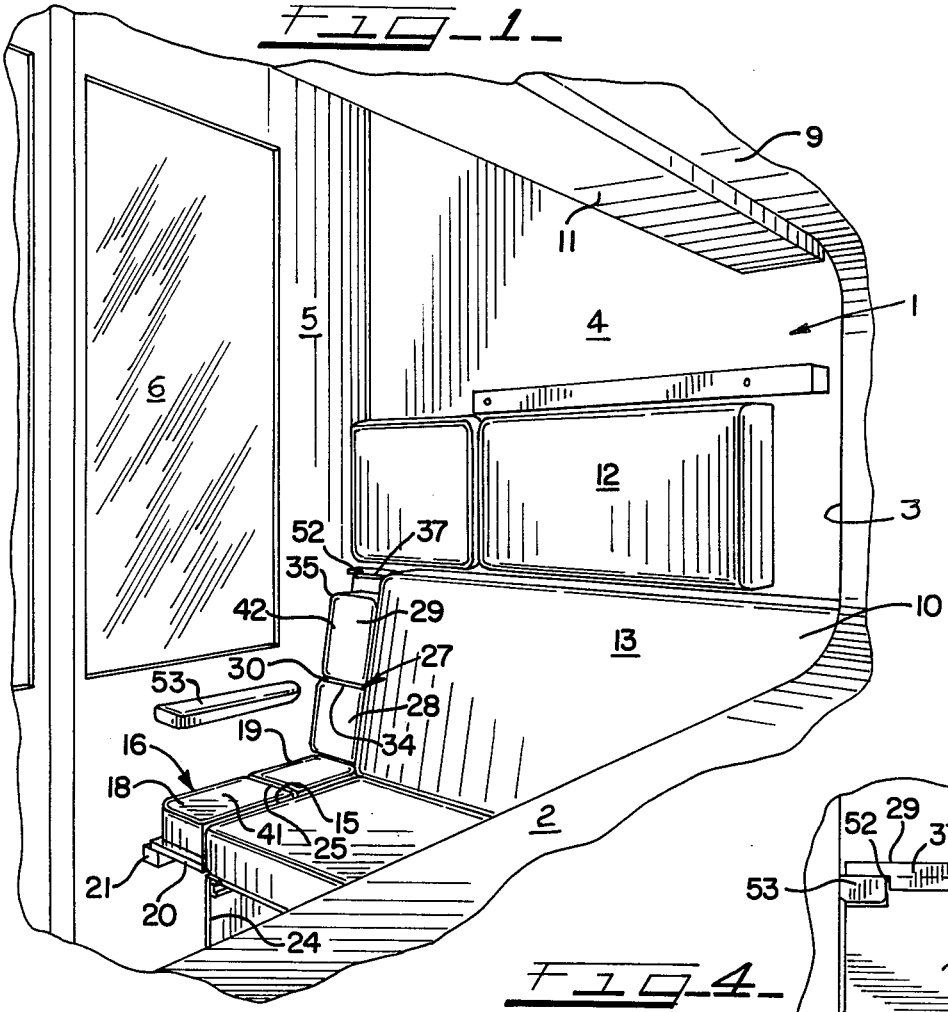
FIG. 4
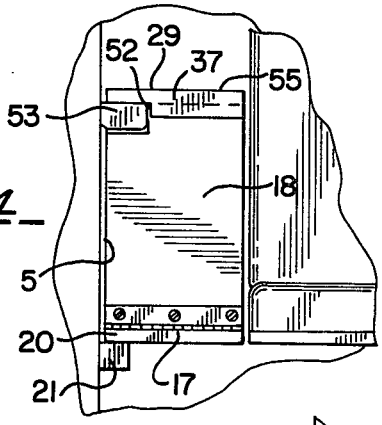
FIG. 2
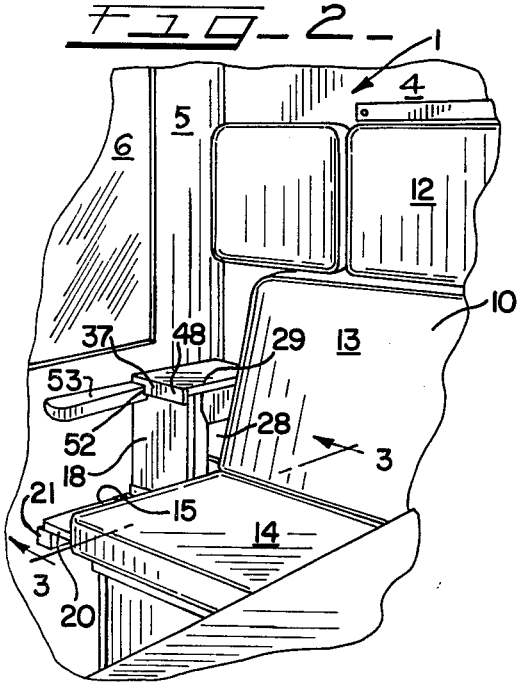
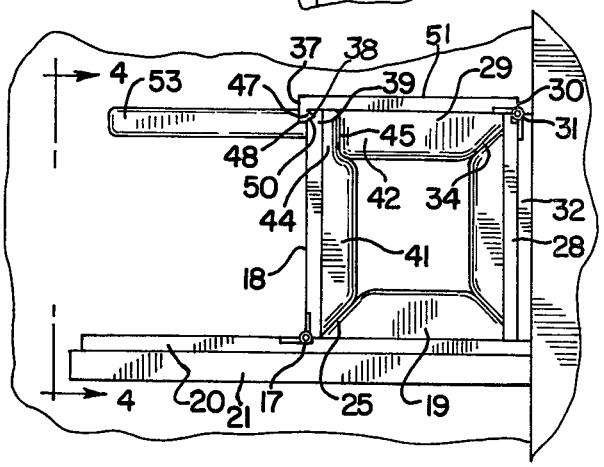
FIG. 3

COMBINATION SEAT AND STEP ARRANGEMENT FOR RAILWAY PASSENGER COMPARTMENT

BACKGROUND OF THE INVENTION

1. Field of the Invention

The present invention pertains to railway passenger cars and in particular to a combination seat and step arrangement for railway passenger compartments.

2. Description of the Prior Art

In a search of the prior art various arrangements of hinged and slidable seat sections are known for positioning a seat and to form a berth or alternatively to form a seat. Such arrangements are shown in U.S. Pat. Nos. 1,233,113 and 544,892. Also various attachments to the seats are known to provide a ladder to the upper berth, for example, U.S. Pat. Nos. 468,493 and 485,151. Support rods forming ladders are also known as in U.S. Pat. No. 451,516. None, however, disclose the novel arrangement of the present invention.

SUMMARY OF THE INVENTION

The present invention discloses a novel seat and step arrangement of a seat having a seating pad wherein parts thereof and of the backrest are foldable to provide a step wherein the seat bottom support forms the other step when the forward section is lifted to form a riser.

The invention comprehends a novel arrangement of seat components which form steps without in any way encroaching upon the available space in the compartment.

It is therefore a principal object to provide a novel assembly of components at one end of a seat in a railway car compartment which with minimum manipulation provides steps for access to the upper berth in a manner which does not interfere with the main seat components which may be manipulated to form a lower berth.

It is another object to provide a seat for a railway car compartment which is unobtrusive and which is readily convertible to a series of steps or as extensions of the back rest and seat, respectively.

These and other objects and advantages inherent in and encompassed in the invention will become more readily apparent from the specification and the drawings.

DESCRIPTION OF THE DRAWINGS

FIG. 1 is a perspective view of approximately one-half of a sleeping car compartment showing the novel components in the seat-extension position;

FIG. 2 is a similar perspective view showing the components in a step arrangement;

FIG. 3 is an enlarged sectional view taken on line 3—3 of FIG. 2; and

FIG. 4 is a sectional view taken on line 4—4 of FIG. 3.

DESCRIPTION OF THE PREFERRED EMBODIMENT

Having reference to the drawings, FIGS. 1 and 2 show a portion of a railway sleeper car compartment. The compartment 1 includes an outer car wall 2 having a window 3, laterally inwardly extending partition walls 4, an inner longitudinal divider wall 5 including a window 6, door opening and floor (not shown), and a ceiling or roof 9.

The compartment may include one or more seats 10 in face-to-face relation and an upper hinged berth 11 which can be moved between a stored position shown in FIG. 1 and a lowered or made-up position as is well known.

Each seat assembly 10 has a headrest 12 supported from an adjacent partition wall. It also has an upright back rest 13 and a horizontal seat portion 14.

Between the inner end 15 of the seat assembly 10 and the inner divider wall 5, there is provided a seat extension assembly generally designated 16. It will be understood, however, that the extension assembly 16 may be disposed alongside either end of the seat assembly 10.

The extension assembly or combination seat and step assembly 16 comprises a front seat section 18 and a rear seat section 19 which in the seating position are both horizontally disposed as seen in FIG. 1 in lateral extension of the seat cushion 14. The lengths of sections 18 and 19 together equal the width of seat 14, and both sections 18 and 19 are of generally the same thickness as seat 14. The front portion 18 is hinged by hinge 17 at its rear edge to the seat base board 20 suitably supported by a brace 21 on the wall 5 adjacent to its outer edge and upon suitable leg panels 24 which at their lower ends mount on the car floor. The hinge 17 is adjacent to the forward end 25 of the rear section 19 which is suitably secured to the base board 20 in stationary position.

The assembly 16 also includes an upright backrest extension 27 which has a lower part 28 fixedly secured to the wall 4 and an upper part 29 which normally lays flat against the wall 4 in coplanar lateral extension of the backrest 13. The lower end 30 of part 29 is connected adjacent to the upper end 34 of the lower part 28 of the backrest extension by a hinge 31 to a bracing board 32 forming part of wall 4.

The free end 35 of the upper part of the portion 29 has a hook-shaped end 37 providing a hooking slot 38 which admits the free edge 39 of the forward part 18 when the same is raised from the position of FIG. 1 to the position of FIG. 2 whereat the parts 18 and 29 are interlocked normal to each other and in such position the part 18 forms a step riser and part 29 a step. The cushions of these parts are concealed within the configuration as seen in FIG. 3 wherein it will be observed that the sponge rubber or foamed polyurathane cushion blocks 41, 42 butt each other and the end 44 of block 41 compresses against the end portion 45 of block 42 thus tightly locking the part 29 and section 18 together. If desired interlocking portions may be provided in the form of a notch and nib 47 on the outer jaw 48 of the hook end 37, and a notch 50 on the underside of base board 51 of the portion 18.

It will be noted in FIGS. 2 and 4 that the jaw 48 is provided with a notch 52 to accommodate the arm rest 53 provided on wall 5 and which serves as an additional support for the step formed by portion 29.

It will be noted that elevation of the portion 18 uncovers the portion of the base board 20, therebeneath which forms the first step; that the section 18 when vertically positioned provides a riser for the second step which is provided by the base board 55 of the portion 29.

Thus a novel and effective step arrangement has been provided which does not encroach upon the limited space of the compartment, is aesthetically pleasing and conforms to the requirements and is relatively simple to reposition from a step arrangement to a seat contour.

What is claimed is:

1. A combination seat and step arrangement for providing access to an upper bed of a railway car compartment, said seat comprising a seating section and a backrest section, a lateral extension assembly of said seating and backrest sections comprising a seating extension and backrest extension, said seating extension comprising front and rear sections substantially coextensive with one end of said seating section and said backrest extension having upper and lower portions substantially coextensive with a corresponding end of said backrest section, the front section and the upper portion being pivotably connected along and positionable generally normal to said seating and backrest sections, respectively, and having distal end portions adapted to interengage in stable supporting relation to each other to form a step providing means for access to said upper bed.

2. The invention according to claim 1, wherein said front section and upper portion are each hinged to swing from a position coplanar with said seating section and said backrest section, respectively, to a stepforming position.

3. The invention according to claim 2, and means for interlocking said front section and upper portion with each other at distal ends.

4. The invention according to claim 3, and said front section and upper portion having cushions thereon compressible against each other in the step forming assembly of said portions for biasing said interlocking means into interengaging relationship.

5. For a sleeping compartment in a railway passenger car having wall structures including a longitudinal wall and longitudinally spaced laterally extending partition walls connected thereto, an upper bed mounted on said wall structure, and a passenger seat beneath said upper bed having seating and backrest elements, corresponding end portions of each of said elements each having a section pivotably connected to the respective element being positionable in a first position as part of the respective element of the seat and said sections pivotable into a second position wherein interengagement of distal ends of said sections form a stable step at one end of said seat providing access means to said upper bed.

6. The invention according to claim 5 wherein said sections are adapted to be arranged as a vertical riser and as a horizontal step and latch means for interlocking the same at their juncture.

7. The invention according to claim 5 and said longitudinal wall comprising an arm rest extending therefrom toward said seat and one of said sections forming the step adapted to overlap said arm rest for support thereby.

8. For a sleeping compartment in a railway passenger car having a wall structure, an upper bed mounted on the wall structure, and a passenger seat beneath said upper bed having seating and backrest elements, corresponding end portions of each of said elements each having a section pivotably connected to the respective element being positionable in a first position as part of the respective element of the seat and said sections pivotable into a second position wherein interengagement of distal ends of said section form a stable step at one end of said seat providing access means to said upper bed, and said seating element also comprising a base and said sections being hinged, respectively, to the seat base and to an adjacent lateral partition wall which forms a portion of said backrest element.

9. For a sleeping compartment in a railway passenger car having a wall structure, an upper bed mounted on the wall structure, and a passenger seat beneath said upper bed having seating and backrest elements, corresponding lateral end portions of each of said elements each having a section pivotably connected to the respective element along an axis parallel to each of said elements and being in a first position as part of the respective element of the seat and said sections pivotable into a second position wherein interengagement of distal ends of said sections form a stable step at one end of said seat providing access means to said upper bed, wherein the distal end of one of the sections comprises a hook portion receiving an end of the other section.

10. The invention according to claim 9 and detent means comprising a nib on the hook portion and a nib-receiving notch in the other section.

11. The invention according to claim 9 and cushion means on said sections formed and arranged to reactively provide a locking effect of said hook portion with the end of the other section.

* * * * *